US011441398B2

(12) United States Patent
Stautzenberger et al.

(10) Patent No.: US 11,441,398 B2
(45) Date of Patent: Sep. 13, 2022

(54) WELL BARRIER AND RELEASE DEVICE FOR USE IN DRILLING OPERATIONS

(71) Applicant: Halliburton Energy Services, Inc., Houston, TX (US)

(72) Inventors: Arthur Terry Stautzenberger, Georgetown, TX (US); Klaus Mikkelsen, Sandness (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/800,228

(22) Filed: Feb. 25, 2020

(65) Prior Publication Data

US 2020/0291756 A1 Sep. 17, 2020

Related U.S. Application Data

(60) Provisional application No. 62/817,201, filed on Mar. 12, 2019.

(51) Int. Cl.
*E21B 43/10* (2006.01)
*E21B 34/14* (2006.01)

(52) U.S. Cl.
CPC ..... *E21B 43/108* (2013.01); *E21B 34/14* (2013.01); *E21B 2200/04* (2020.05)

(58) Field of Classification Search
CPC .... E21B 43/108; E21B 34/14; E21B 2200/04; E21B 33/04; E21B 21/003
See application file for complete search history.

(56) References Cited

U.S. PATENT DOCUMENTS 4,712,614 A * 12/1987 Allwin ..... E21B 23/01 166/208
5,667,023 A 9/1997 Harrell
9,567,834 B2 2/2017 Moffitt et al.
2004/0011534 A1 1/2004 Simonds
(Continued)

FOREIGN PATENT DOCUMENTS

WO 2018102459 A1 6/2018
WO 2018217727 A1 11/2018

OTHER PUBLICATIONS

Netherlands Search Report dated Nov. 27, 2020, NL Patent Application No. 2025031.

(Continued)

*Primary Examiner* — Dany E Akakpo
(74) *Attorney, Agent, or Firm* — McGuireWoods LLP

(57) ABSTRACT

A well barrier plug and disconnect system for use during drilling operations in wellbore environments. The system comprises of a liner hanger, valve, and a drilling assembly coupled to a liner hanger running tool. The system is used to performing drilling operations in downhole wellbore environments with high risk of uncontrollable losses, cavernous zones, karst formations, or well control issues. In the event the well is on uncontrollable losses or a well control issue occurs, the liner hanger can be set into the downhole wellbore casing and a valve connected below the liner hanger can be closed creating a barrier plug in the well. Further disconnecting the liner hanger running tool from the liner hanger, valve, and drilling assembly allows retrieval of the upper drilling assembly section from the well.

11 Claims, 4 Drawing Sheets

(56) References Cited

U.S. PATENT DOCUMENTS

| | | | | |
|---|---|---|---|---|
| 2010/0276153 | A1* | 11/2010 | Gette | E21B 33/04 166/351 |
| 2016/0024896 | A1 | 1/2016 | Johnson et al. | |
| 2017/0370179 | A1 | 12/2017 | Vasques | |
| 2018/0187492 | A1 | 7/2018 | Amri | |
| 2018/0340381 | A1* | 11/2018 | Zhou | E21B 4/02 |

OTHER PUBLICATIONS

International Search Report and Written Opinion dated Jun. 19, 2020, International PCT Application No. PCT/US2020/020606.

* cited by examiner

WELL BARRIER AND RELEASE DEVICE FOR USE IN DRILLING OPERATIONS

CROSS-REFERENCE TO RELATED APPLICATIONS

This application claims the benefit of and priority to U.S. Provisional Application No. 62/817,201, filed Mar. 12, 2019, which is hereby incorporated by reference.

BACKGROUND

In well site drilling operations, formations can be encountered that contain caverns or zones that are so large that a well can go into total loss. Due to the sheer volume of the cavern or zone, the loss rate can be so severe that it is difficult to keep the well filled. The amount of mud required to fill the cavernous formation can result in significant logistical and financial challenges. Alternatively, there can be a risk of gas migration and major well control issues. In severe events, the cost, time, and safety issues can result in the requirement to plug the wellbore and disconnect from the drilling assembly.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

A well barrier plug and disconnect system for use during drilling operations in wellbore environments is presented. In an embodiment, a liner hanger, a valve, and a liner hanger running tool are used in a drilling assembly to provide well site operators with an option to plug and isolate a downhole wellbore environment and disconnect from the lower part of the drill string stopping losses and preventing a well control issue. Although traditionally, liner hangers are not used as wellbore plugs in actual drilling operations, the inventors have discovered in certain drilling operations that the combination of a liner hanger and a valve are quite effective at forming an ad hoc plug and disconnect tool if needed during drilling operations. In operation, the liner hanger running tool acts as a release device and the liner hanger and the valve acts as a downhole wellbore barrier. In an embodiment, the liner hanger can be set in a downhole wellbore casing, functioning as a seal between the liner hanger and the wellbore casing and also functioning to anchor the liner hanger and lower drilling assembly to the wellbore casing. Once the liner hanger is set into the wellbore casing, the liner hanger running tool can be released from the liner hanger and retrieved with the upper drilling assembly. Prior to or during the retrieval of the liner hanger running tool, a valve below the liner hanger can be closed to function as a seal to the wellbore. Once set, the liner hanger will remain anchored to the wellbore casing. The valve and lower drilling assembly are suspended from the liner hanger and will remain downhole. The liner hanger and valve together form the barrier against the downhole wellbore environment.

Figure 1:
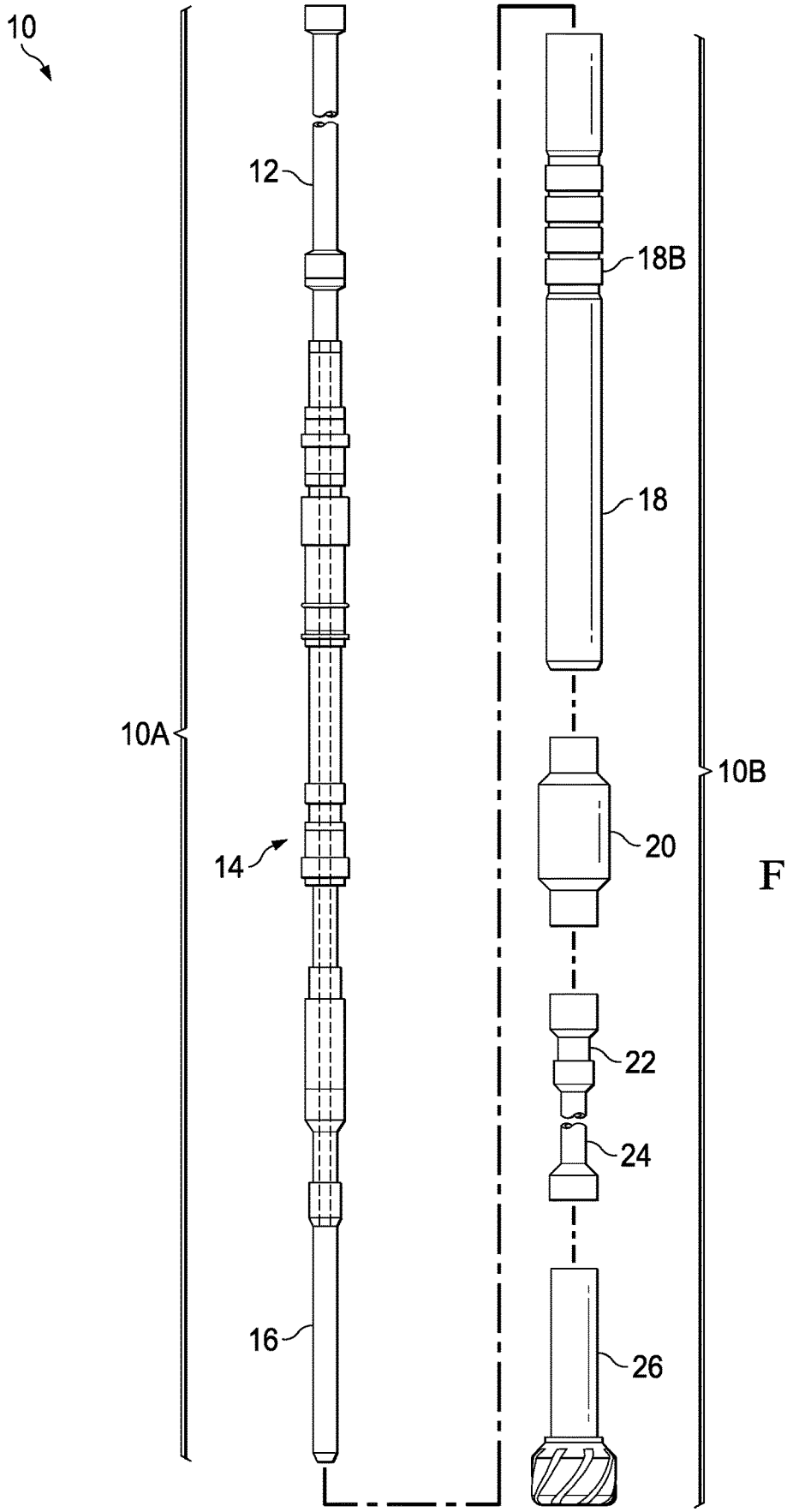
FIG. 1 is an illustration of a drill string for use in well site drilling operations, in accordance with certain example embodiments.

Referring now to FIG. 1, illustrated is a drilling assembly for use in well site drilling operations, according to certain example embodiments, denoted generally as 10. The drilling assembly 10 comprises a drilling tubular section 12, a liner hanger running tool 14, an extension pipe or shifter 16, a liner hanger 18, e.g. either conventional or expandable liner hanger, a valve 20, a crossover 22, another drilling tubular section 24, and a drilling bottom hole assembly (drilling BHA) 26. In an embodiment, the running tool 14 can be used to activate the liner hanger 18 by application of hydraulic pressure or mechanical manipulation of the drilling tubular section 24. The valve 20 can be any type of valve such as (but not limited to) a ball valve, flapper valve, or ball seat. The valve 20 can be actuated by many methods such as (but not limited to) mechanical manipulation of an extension pipe, operation of a shifting tool, hydraulic pressure, electronic activation, etc. One example method is for valve 20 to be a ball valve and extension pipe 16 to be a shifter used to manipulate the position of a sleeve, which in turn can cause the valve to close when the liner hanger running tool 14 is retrieved. Another example method is for valve 20 to be a flapper valve, and the extension pipe 16 functions to hold the flapper valve in the open position until it is retrieved with the liner hanger running tool. In yet another example method, the valve 20 can be a simple ball seat which is closed by dropping a ball from the surface which will land on the ball seat to seal the wellbore. The crossover 22 can be used to couple the barrier device to the drilling tubular 24.

Figure 2A:
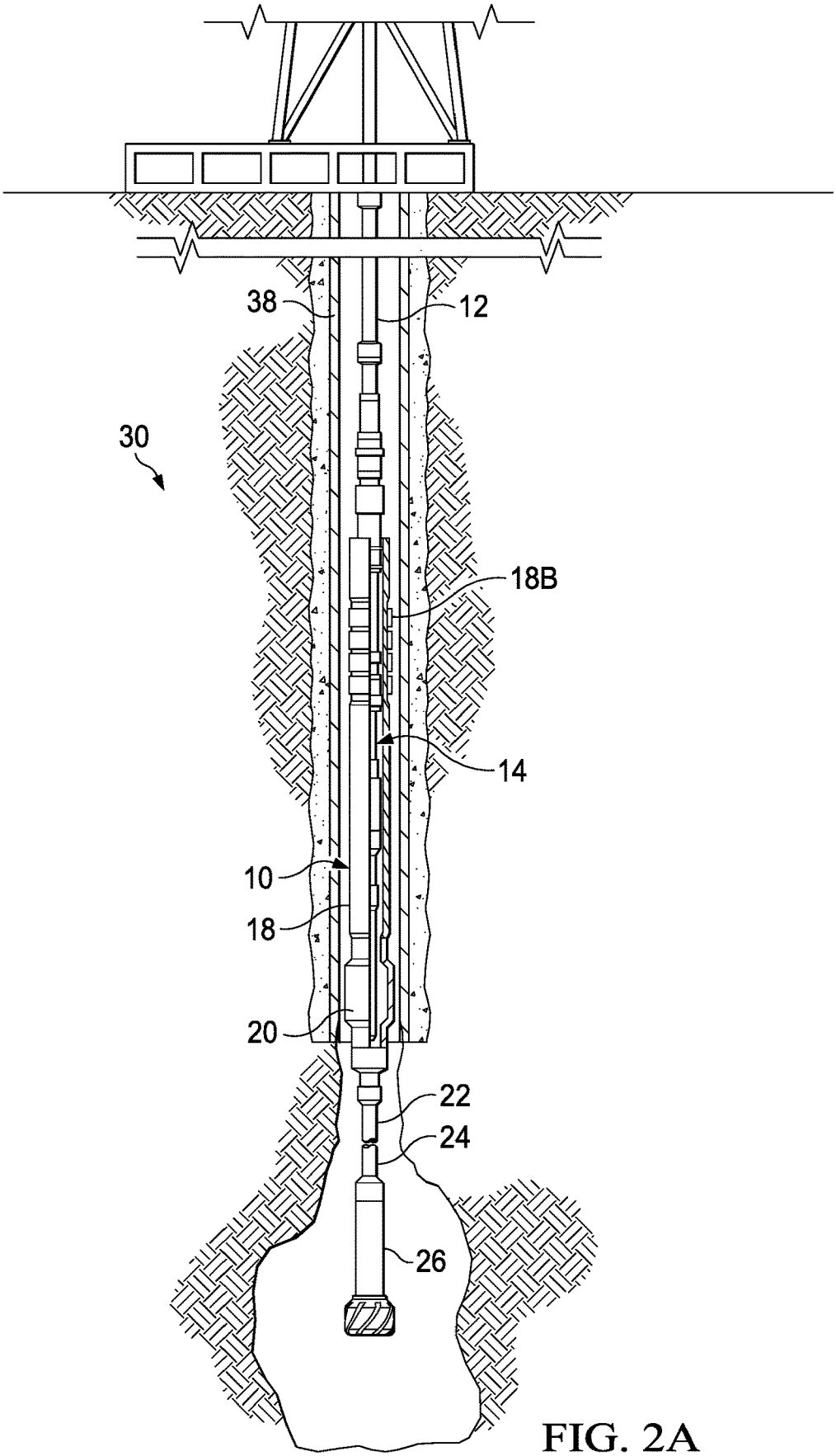
FIGS. 2A and 2B are illustrations of an assembled drill string during drilling operations and a released, anchored section of the drill string after encountering adverse drilling conditions, respectively, in a wellbore, in accordance with certain example embodiments.
Figure 2B:
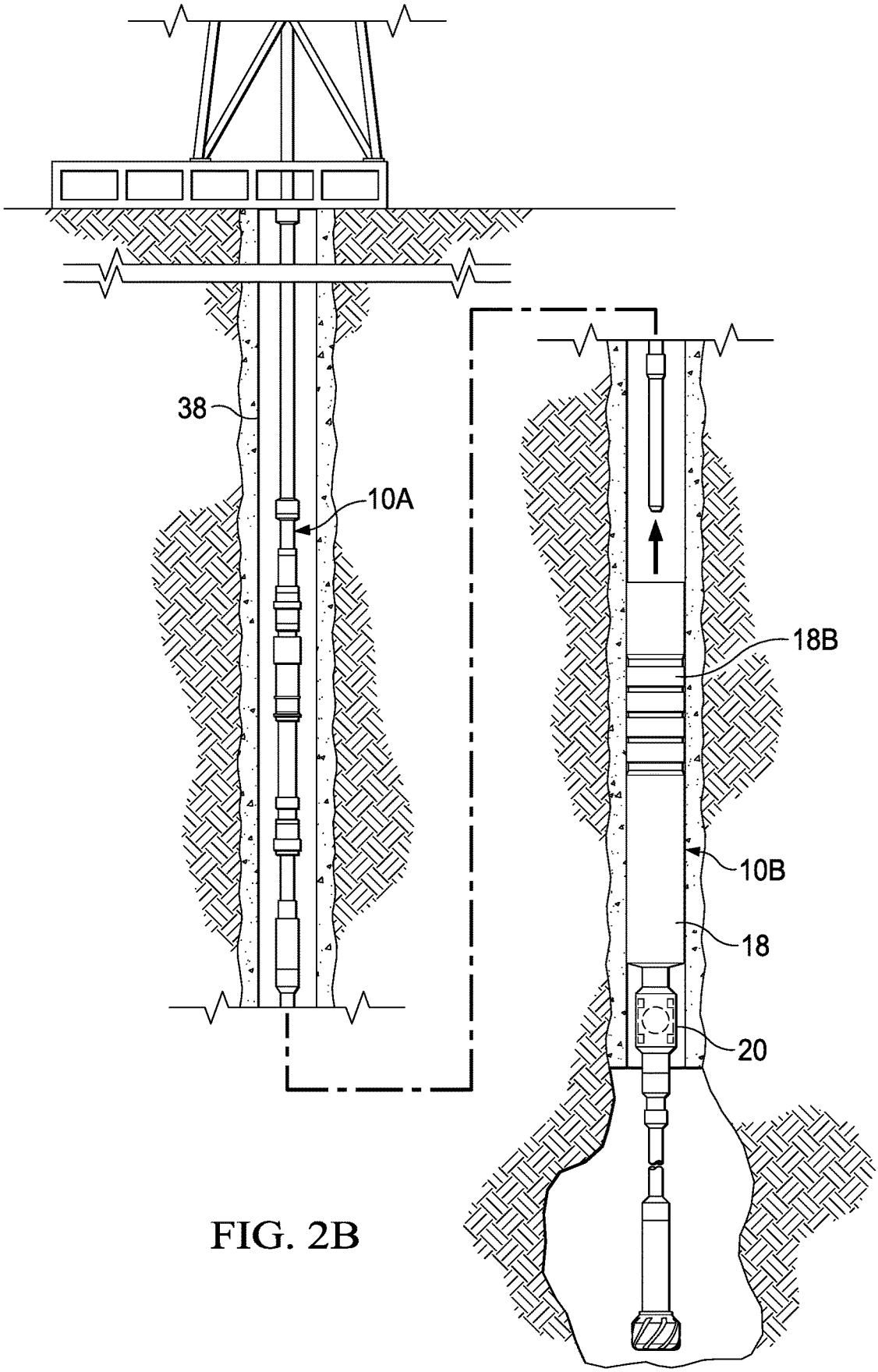

Referring to FIG. 2A, illustrated is a drilling assembly 10, used during drilling operations and referring to FIG. 2B, illustrated is an anchored section of the lower drilling assembly 10*b* and a released section of the upper drilling assembly 10*a* after encountering adverse drilling conditions, in a wellbore 30, according to certain example embodiments. As is illustrated in FIG. 2A, the drilling assembly 10 is suspended from a drilling rig. As the BHA 26 is being manipulated to drill through earth formations, the BHA 26 may drill through to a cavernous zone or encounter a well control issue. Depending on the circumstances, the operator may deem it necessary to plug the well and disconnect from the BHA 26 and retrieve the upper section of the drilling string 10*a*, see FIG. 2B. In an embodiment, the liner hanger 18 can be either a conventional or expandable liner hanger. Once set, liner hanger 18 is securely coupled with downhole well casing 38 and the liner hanger element 18B provide a secure seal between the liner hanger 18 and the downhole well casing 38. The valve 20 can be closed either before or after the liner hanger 18 is set.

Figure 3A:
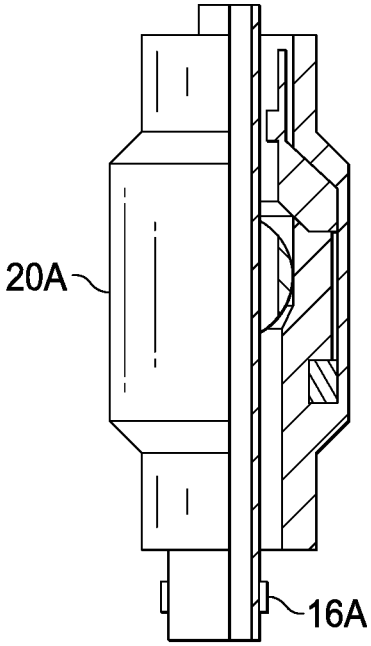
FIGS. 3A, 3B, and 3C are illustrations of a ball valve 20A, flapper valve 20B, and ball seat 20C, in accordance with certain example embodiments.
Figure 3C:
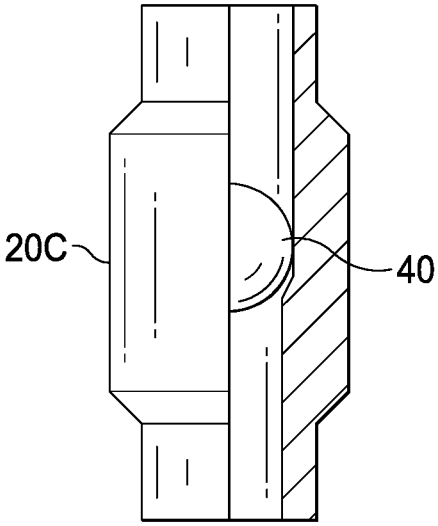
Figure 3B:
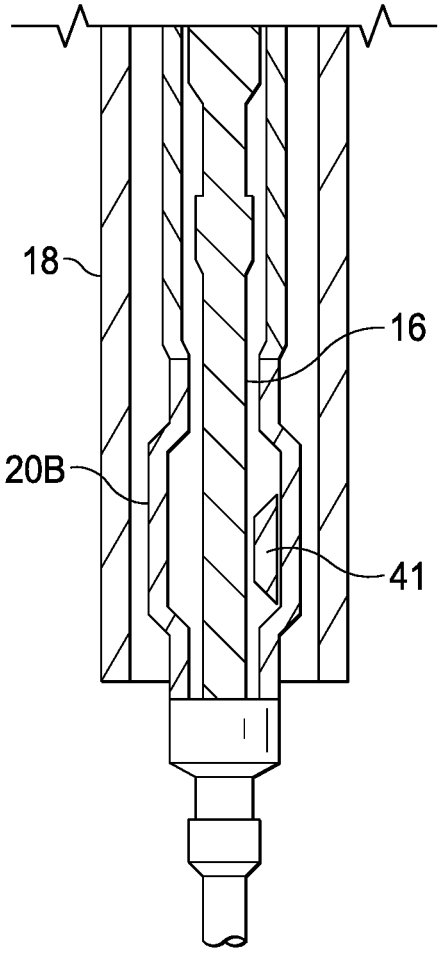

Referring now to FIGS. 3A, 3B, and 3C, illustrated are a ball valve 20A, a flapper valve 20B, and a ball seat 20C, according to certain example embodiments. Although illustrated are three different types of valves, it should be readily understood that many other types of valves can be used. In the embodiment of FIG. 3A, the ball of the ball valve 20A can be manipulated by using shifter 16A to place the valve into a closed or open position. In the embodiment of FIG. 3B, the flapper valve 20B contains a flapper seat 41 which is biased in the closed position by a spring. The flapper seat 41 is held in the open position by extension pipe 16. The flapper valve 20B is closed when the extension pipe 16 is retrieved allowing flapper seat 41 to close. In the embodiment of FIG. 3C, the valve comprises a top section, i.e. closest to the surface, and a downhole or bottom section, i.e. closest to the floor of the well, and the downhole section comprises a valve seat that has an internal diameter less than the internal diameter of the top section. Ball seats 20C are well known in the oil and gas industry and their design is industry standard. A ball 40 can be dropped from the surface and down the drill string 10 when the valve 20C needs to be closed.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a well barrier and disconnect system for use during drilling operations in wellbore environments, the well barrier and disconnect system comprising: a liner hanger coupling a drilling assembly and a valve with a liner hanger running tool; and a control mechanism to set the liner hanger into the wellbore casing and disconnect the liner hanger running tool from the liner hanger, the valve, and the drilling assembly;

Clause 2, the well barrier and release system of clause 1, wherein the control mechanism comprises a shifter and a sleeve used to open and close the valve in response to disconnecting the liner hanger running tool from the liner hanger and retrieving the liner hanger running tool;

Clause 3, the well barrier and release system of clause 1, wherein the valve comprises a valve seat for receiving a ball and the valve seat having an internal diameter less than the internal diameter of the casing liner;

Clause 4, the well barrier and release system of clause 1, wherein the valve comprises a flapper seat biased in the closed position by a spring, wherein the flapper seat is held in the open position by an extension of the liner hanger running tool and moveable in response to retrieval of the liner hanger running tool;

Clause 5, the well barrier and release system of clause 2, wherein the valve comprises a ball valve that is moveable in response to at least one of a mechanical and an electromechanical force;

Clause 6, the well barrier and release system of clause 1, wherein the liner hanger is one of an expandable liner hanger, a conventional liner hanger, or a packer;

Clause 7, the well barrier and release system of clause 6, wherein the control mechanism is further configured to perform one of: expand the expandable liner hanger to expand against downhole well casing; or anchor the conventional liner hanger or packer with a section of downhole well casing;

Clause 8, a well barrier and disconnect device for use during drilling operations in wellbore environments, the well barrier and disconnect device comprising: a valve having a liner hanger, the liner hanger coupling the valve and a drilling assembly with a liner hanger running tool; and a control mechanism to set the liner hanger into the wellbore casing and disconnect the liner hanger running tool from the liner hanger, the valve, and the drilling assembly;

Clause 9, the well barrier and release device of clause 9, wherein the valve comprises a valve seat for receiving a ball and the valve seat having an internal diameter less than the internal diameter of the casing liner;

Clause 10, the well barrier and release device of clause 8, wherein the valve comprises a valve seat for receiving a ball and the valve seat having an internal diameter less than the internal diameter of the casing liner;

Clause 11, the well barrier and release device of clause 8, wherein the valve comprises a flapper seat biased in the closed position by a spring, wherein the flapper seat is held in the open position by an extension of the liner hanger running tool and moveable in response to retrieval of the liner hanger running tool;

Clause 12, the well barrier and release device of clause 9, wherein the valve comprises a ball valve that is moveable in response to at least one of a mechanical or an electromechanical force;

Clause 13, the well barrier and release device of clause 8, wherein the liner hanger is one of an expandable liner hanger, a conventional liner hanger, or a packer;

Clause 14, the well barrier and release device of clause 13, wherein the mechanism is further configured to perform one of: expand the expandable liner hanger to expand against downhole well casing; or anchor the conventional liner hanger or packer with a section of downhole well casing;

Clause 15, a method of using a well barrier and disconnect system during drilling operations in wellbore environments, the method comprising: using a liner hanger; a valve; and a drilling assembly coupled to a liner hanger running tool during drilling operations; and performing in response to an indication that the wellbore environment is on uncontrollable losses or in the event of a well control issue: setting the liner hanger into the downhole well casing; closing a valve that is connected below the liner hanger; and disconnecting the liner hanger running tool from the liner hanger, valve, and drilling assembly;

Clause 16, the method of clause 15, further comprising closing the valve prior to disconnecting the liner hanger running tool from the liner hanger, valve, and drilling assembly;

Clause 17, the method of clause 15, wherein closing the valve comprises performing one of: dropping a ball into the valve; retrieving an extension pipe to close a flapper valve; or maneuvering a ball valve between an open and closed position;

Clause 18, the method of clause 15, further comprising performing one of: expanding the liner hanger against the downhole well casing; or anchoring the liner hanger into a section of downhole well casing;

What is claimed is:

1. A well barrier and disconnect system for use during drilling operations in wellbore environments, the well barrier and disconnect system comprising:

a liner hanger having a valve and a bottom hole assembly coupled to an end and a liner hanger running tool and a drilling tubular section coupled to another end; and a control mechanism to set the liner hanger into a wellbore casing and disconnect the liner hanger running tool from the liner hanger, the valve, and the bottom hole assembly, wherein the valve comprises a flapper seat biased in the closed position by a spring, and wherein the flapper seat is held in the open position by an extension of the liner hanger running tool and moveable in response to retrieval of the liner hanger running tool.

2. The well barrier and release system of claim 1, wherein the control mechanism comprises a shifter and a sleeve used to open and close the valve in response to disconnecting the liner hanger running tool from the liner hanger and retrieving the liner hanger running tool.

3. The well barrier and release system of claim 1, wherein the liner hanger is one of an expandable liner hanger, a conventional liner hanger, or a packer.

4. The well barrier and release system of claim 3, wherein the control mechanism is further configured to perform one of:

expand the expandable liner hanger to expand against downhole well casing; or anchor the conventional liner hanger or packer with a section of downhole well casing.

5. A well barrier and disconnect device for use during drilling operations in wellbore environments, the well barrier and disconnect device comprising:

a bottom hole assembly and a valve coupled to a first end of a liner hanger, the liner hanger having a second end coupled with a liner hanger running tool and a drilling tubular section; and a control mechanism to set the liner hanger into a wellbore casing and disconnect the liner hanger running tool from the liner hanger, the valve, and the bottom hole assembly, wherein the valve comprises a flapper seat biased in the closed position by a spring, and wherein the flapper seat is held in the open position by an extension of the liner hanger running tool and moveable in response to retrieval of the liner hanger running tool.

6. The well barrier and release device of claim 5, wherein the liner hanger is one of an expandable liner hanger, a conventional liner hanger, or a packer.

7. The well barrier and release device of claim 6, wherein the mechanism is further configured to perform one of: expand the expandable liner hanger to expand against downhole well casing; or anchor the conventional liner hanger or packer with a section of downhole well casing.

8. A method of using a well barrier and disconnect system during drilling operations in wellbore environments, the method comprising:

using a liner hanger; a valve; and a drilling assembly coupled to a liner hanger running tool during drilling operations; and performing in response to an indication that a wellbore environment is on uncontrollable losses or in the event of a well control issue:

setting the liner hanger into a downhole well casing;

closing the valve that is connected below the liner hanger; and disconnecting the liner hanger running tool from the liner hanger, valve, and drilling assembly.

9. The method of claim 8, further comprising closing the valve prior to disconnecting the liner hanger running tool from the liner hanger, valve, and drilling assembly.

10. The method of claim 8, wherein closing the valve comprises performing one of:

dropping a ball into the valve;

retrieving an extension pipe to close a flapper valve;

or maneuvering a ball valve between an open and closed position.

11. The method of claim 8, further comprising performing one of:

expanding the liner hanger against the downhole well casing;

or anchoring the liner hanger into a section of downhole well casing.

* * * * *